US005547422A

United States Patent [19]

Seboldt

[11] Patent Number: 5,547,422

[45] Date of Patent: Aug. 20, 1996

[54] ACCESSORY VENT DUCT OUTLET PROTECTOR AUXILIARY

[76] Inventor: David A. Seboldt, 6118 S. Rural Dr., Indianapolis, Ind. 46227

[21] Appl. No.: 430,843

[22] Filed: Apr. 28, 1995

[51] Int. Cl.[6] ..... F24F 13/10

[52] U.S. Cl. ..... 454/359; 34/235

[58] Field of Search ..... 34/235; 55/282, 55/505; 126/85 B; 454/353, 358, 359, 361, 363

[56] References Cited

U.S. PATENT DOCUMENTS

| | | | |
|---|---|---|---|
| 3,087,563 | 4/1963 | Fisher | 55/282 X |
| 4,090,436 | 5/1978 | Wright | 454/368 X |
| 4,934,334 | 6/1990 | Breese | 126/85 B |
| 5,046,408 | 9/1991 | Eugenio | 454/359 |
| 5,383,816 | 1/1995 | Marcello et al. | 454/359 |
| 5,409,932 | 4/1995 | Joseph et al. | 126/85 B X |

*Primary Examiner*—Harold Joyce
*Attorney, Agent, or Firm*—Robert A. Spray, Patent Atty.

[57] ABSTRACT

An outlet protector auxiliary, for a vent duct which leads exhaust substance from equipment, such as lint and moisture from a clothes dryer, for venting discharge exteriorly of a building's wall, the vent duct outlet having a movable closure flap which has a substance-discharge position and a closed position. The auxiliary is in the form of a metal framework providing a cage-like body member, having enclosure panels having openings of a restricted size such as to permit discharge of exhaust through the openings but to block entry into the duct, from the wall's exterior, of matter of any size significantly larger than the particles of exhaust substance for which the auxiliary is provided; and the cage-like body member has a peripheral flange by which it is connected to the wall. A portion of the cage-like body member is provided with a hinge, providing that a portion of the panel is movable to an open condition such that a user may reach into the cage-like body member to remove trapped sediment or the like which has collected.

14 Claims, 5 Drawing Sheets

ACCESSORY VENT DUCT OUTLET PROTECTOR AUXILIARY

FIELD AND BACKGROUND OF THE INVENTION

The present invention relates to ductwork typified by the ductwork which leads from clothes dryer apparatus outwardly through a wall of the building, getting rid of moisture and lint particles which have been shed in the drying operation.

More particularly, the present invention relates to a protector auxiliary for the ductwork, providing a mask-like barrier, operatively enclosing the outlet of the ductwork, to prevent birds and other animal life from entering the ductwork.

Still more particularly, the present invention relates to such a screen-like device which, when covering the outlet of the ductwork, permits the outward flow of the moisture and lint particles, together with the air which is the carrier fluid for the drying operation, yet prevents the animal life from entering through that open duct outlet.

PROBLEMS INHERENT AS TO PROTECTION OF DUCTWORK

Ductwork from clothes dryers, and even ductwork from non-lint sources such as bathroom exhaust ductwork, obviously is subject to the nuisance of birds and other animal life entering the open outlet end of the ductwork.

And even though most of such ductwork is protected by some sort of a "check valve" device, such as a hinged flapper plate or a grid-like series thereof, birds in particular seem to want to bite into the outlet components of the ductwork, and build nests. And once the outlet components have been bitten into, birds and other animal life enter into the ductwork, causing many problems.

A particular problem of ductwork is that its symptoms of trouble and maintenance-need give an illusion of the problem being other than the outlet-blocking which is caused by the bird nests. That is, the blocking causes a retardation of the exhaust of moisture, and thus not only is the amount of carrier air diminished but moisture in the form of vapor or even trickling droplets backs up into the dryer chamber; and this gives an illusion of malfunction of the heater coils and/or motor.

Accordingly, much electricity and time are wasted because dryer cycles have to be multiplied, extra service calls are needed, and the attention of the homeowner and serviceman is directed toward the dryer components, for expensive maintenance and/or replacement, rather than simply to the quite accessible dryer duct outlet components.

The particular problems for a practical and effective shield for duct outlet components include problems of operativity, ruggedness, non-restriction of the exhaust airflow, attractiveness of a building-exterior component, ease of installation, ease of cleanout, etc.

SUMMARY OF THE INVENTIVE CONCEPTS

The invention provides a novel and advantageous outlet protector auxiliary, protecting a vent duct from birds or other animal life entering the duct. Their nests and/or droppings are of course quite objectionable, and even a small amount of such unwanted matter can cause problems of odor and/or vent blockage and/or vent-flap sticking in an open position letting cold air come into the vent line and the building's interior.

The auxiliary also provides a barrier against birds and other animal life biting portions of the closure flaps, which causes similar disadvantages. More particularly, the auxiliary protects a vent duct of a type which leads exhaust substance such as lint and moisture being conveyed from a clothes dryer, for its venting discharge exteriorly of a building's wall, the vent duct outlet having a movable closure flap which has a substance-discharge position and a closed position.

Any substantial amount of buildup, of bird nests for example, can even impose such a vent-blocking effect that the moisture buildup from the clothes dryer is caused to either trickle back into the dryer or at least prevent the clothes dryer from achieving dryer operativity. Any of this can cause the homeowner to assume, wrongly, that the dryer's motor and/or heater components needs replacement, and at least extra service call or calls' are wasted because of the wrong diagnosis as to the cause of clothes not being satisfactorily dried.

Even without the waste and expense of service calls, the homeowner wastefully attempts to correct the problem by repetitive dryer cycles, with a consequent great waste and cost of electricity and/or gas.

The temptation for a serviceman to replace motor and/or heater components has no doubt led to needless replacement of parts, and needless service, all of course at the homeowner's expense.

Also, lint buildup, as caused by bird nests, has been so extensive in the form of an upstream backup into the interior ductwork, as to cause a fire hazard, the buildup reaching so close to the dryer's heater element.

Even without the extra hazard of highly combustible lint backup, non-lint bathroom exhaust ductwork causes a special hazard, that once birds get into interior ductwork and are able to peck a hole in it, they or rodents can get into walls or interior spaces of the building, causing obvious hazards and disagreeable effects.

The auxiliary is economically formed as a metal framework which provides a cage-like body member, having enclosure panels having openings of a restricted size, i.e., of a size such as to permit discharge of exhaust through the openings but to block entry into the duct, from the wall's exterior, of matter of any size significantly larger than the particles of exhaust substance for which the auxiliary is provided.

The cage-like body member has a peripheral flange by which it is connected to the wall by screws or other fastening means.

In a preferred embodiment, a portion of the cage-like body member is provided with a hinge, providing that a portion of the panels is movable to an open condition such that a user may reach into the cage-like body member to remove trapped sediment or the like which has collected.

PRIOR ART CAPABILITY AND MOTIVATIONS, AS HELPING TO SHOW PATENTABILITY HERE

Even in hindsight consideration of the present invention to determine its inventive and novel nature, it is not only conceded but emphasized that the prior art had many details usable in this invention, details of both capability and motivation, but only if the prior art had had the guidance of the present concepts of the present invention.

That is, it is emphasized that the prior art had/or knew several particulars which individually and accumulatively show the non-obviousness of this combination invention. E.g.:

a. The prior art has had various types of cages, screens, barred enclosures, and similar articles for scores of years, of many shapes, natures, and sizes;

b. Such articles have included not only various types of birdcages and other cages and barred enclosures to keep animal life confined, but doors' and window screens to keep animal life out;

c. Various types of masks, such as for athletic use, provide a screening or barrier function; and these are well known;

d. Ductwork outlets have always needed shields, and the prior art has provided various types of shields for whatever purpose is needed for scores of years;

e. The disadvantages as to the lack of a practical outlet protector, as summarized herein, are so great and would likely have been noticed by so many users and servicemen, that this invention might have been born out of need but only if its concepts had been obvious;

f. The ease of tooling for the present invention has surely given manufacturers ample incentive to have made articles and modifications for commercial competitiveness in a competitive industry, if the concepts had been obvious;

g. The features of the present invention are reasonably likely considered by manufacturers and users to be of such an obvious advantage that manufacturers and/or users would likely consider protectors of this invention to have massive sales opportunities to a great multitude of persons; and thus manufacturers and/or users would have been likely to have developed this ductwork outlet protector of this invention, if its concepts had been obvious;

h. The prior art has always had sufficient skill to make many types of duct outlet protectors, more than ample skill to have achieved the present invention, but only if the concepts and their combination had been conceived;

i. Substantially all of the operational characteristics and advantages of details of the present invention, when considered separately from one another and when considered separately from the present invention's details and non-technical accomplishment of the details, are within the skill of persons of various arts, but only when considered away from the integrated and novel combination of concepts which by their cooperative combination achieves this advantageous invention;

i. The details of the present invention, when considered solely from the standpoint of construction, are exceedingly simple; and the matter of simplicity of construction has long been recognized as indicative of inventive creativity;

k. Similarly, and a long-recognized indication of inventiveness of a novel combination, is the realistic principle that a person of ordinary skill in the art, as illustrated with respect to the claimed combination as differing in the stated respects from the prior art both as to construction and concept, is presumed to be one who thinks along the line of conventional wisdom in the art and is not one who undertakes to innovate; and l. Far from being in a specialized field in which only a relatively few specialists, researchers, professional persons or experienced inventors could have perceived and overcome this practically universal problem, here the vast majority of all persons, for scores of years, must be realistically considered as prime candidates for this invention; and thus its non-obviousness seems proven by history.

Accordingly, although the prior art has had capability and motivation, amply sufficient to presumably give incentive to the development of a novel and practical protector according to the present invention, the fact remains that this invention awaited the creativity and inventive discovery of the present inventor. In spite of ample motivation and capability shown by the many illustrations herein, the prior art did not suggest this invention.

PRIOR ART AS PARTICULAR INSTANCES OF FAILURE TO PROVIDE THIS OUTLET PROTECTOR AUXILIARY

In view of the industry motives and capabilities, it may be difficult to realize that the prior art has not projected itself to the combination purpose and achievement of the present invention, even though the need and use of duct outlet protectors is a widespread and quite universal factor, and the hardware industry is quite commercial and competitive. Further, ductwork users surely include an uncountable multitude of inventors and other persons, even "do it yourself" homeowners, at least of sufficient experience, skill, etc., that the present invention would have been desired and attempted, and perhaps achieved, long ago, but only if its factors and combination-nature had been obvious.

Moreover, prior art articles known to this inventor, which could possibly be adapted for this duty, fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backward look into the prior art, especially since the prior art has long had much motivation as to details of the present invention and to its provisions.

As to a one-way barrier, as a function or capability, nothing is here asserted to be novel; and, in contrast, the concepts of the present invention provide the building upon the principal nature and function of earlier ductwork accessories, rather than any modification of the one-way barrier function itself.

SUMMARY OF THE PRIOR ART'S LACK OF SUGGESTIONS OF THE CONCEPTS OF THE INVENTION'S COMBINATION

In spite of all such factors of the prior art, the problem here solved awaited this inventor's consideration, ideas, and creativity. More particularly as to the novelty here of the invention as considered as a whole, the resume of the prior art uses and needs helps show its contrast to the present concepts, and emphasizes the advantages, novelty, and the inventive significance of the present concepts as are here shown, particularly as to utility and convenience of use as detailed herein, as to apparatus and a procedure.

Although varieties of prior art are conceded, and ample motivation is shown, and full capability in the prior art is conceded, no prior art shows or suggests details of the overall combination of the present invention, as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of an economical protector feature achieving the convenience, ease of installation, ease of use, simplicity of use, and other advantages of the present invention, which are goals only approached by the prior art, must be recognized as being a long-felt need accomplished.

Accordingly, the various concepts and components are conceded and emphasized to have been widely known in the prior art as to various devices, nevertheless, the prior art not having had the particular combination of concepts and as here presented and shown in novel combination different from the prior art and its suggestions, even only a fair amount of realistic humility, to avoid consideration of this invention improperly by hindsight, required the concepts and achievements here to be realistically viewed as a novel combination, inventive in nature. And especially is this a realistic consideration when viewed from the position of a person of ordinary in this art at the time of this invention, and without trying to reconstruct this invention from the prior art without use of hindsight toward particulars not suggested by the prior art.

BRIEF DESCRIPTION OF THE DRAWINGS

The above description of the novel and advantageous invention is of somewhat introductory and generalized form. More particular details, concepts, and features are set forth in the following and more detailed description of an illustrative embodiment, taken in conjunction with the accompanying Drawings, which are of somewhat schematic and diagrammatic nature for showing the inventive concepts; and in the Drawings.

DETAILED DESCRIPTION OF ILLUSTRATIVE EMBODIMENT

Figure 1:
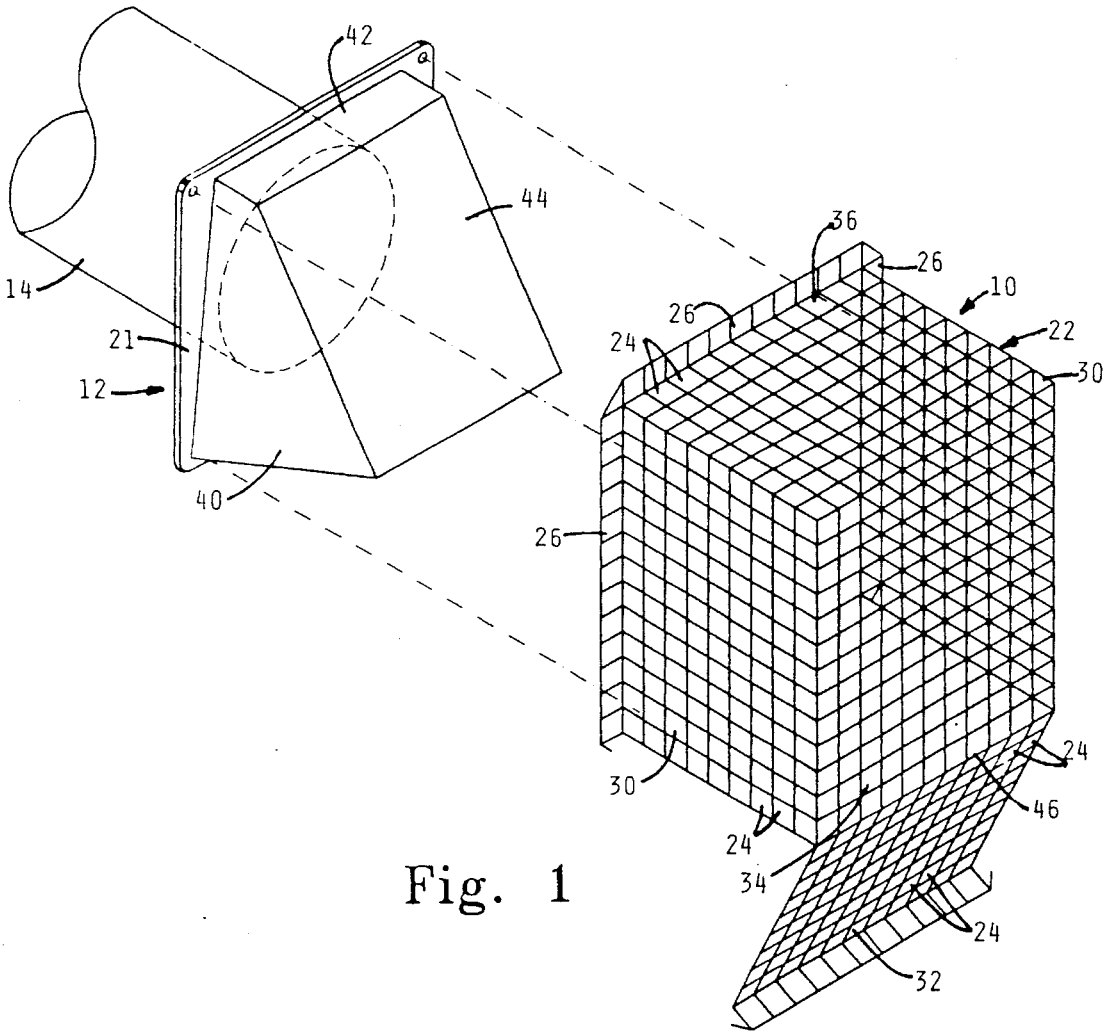
FIG. 1 is an isometric pictorial exploded view of a vent duct outlet protector auxiliary of the present invention, shown as aligned to be installed on an associated vent duct outlet, the protector auxiliary device being shown with its bottom-panel swung to an open position as it would be for removal of trapped sediment during use of the device.

As shown in the Drawings, the present invention provides a novel and advantageous protector 10 as an auxiliary for the duct outlet 12 of an associated accessory vent duct 14.

The accessory vent duct 14 is typically one which leads exhaust substance from associated equipment such as a clothes dryer interiorly of a building wall 16, in a function of venting discharge exteriorly of the wall 16.

Figure 4:
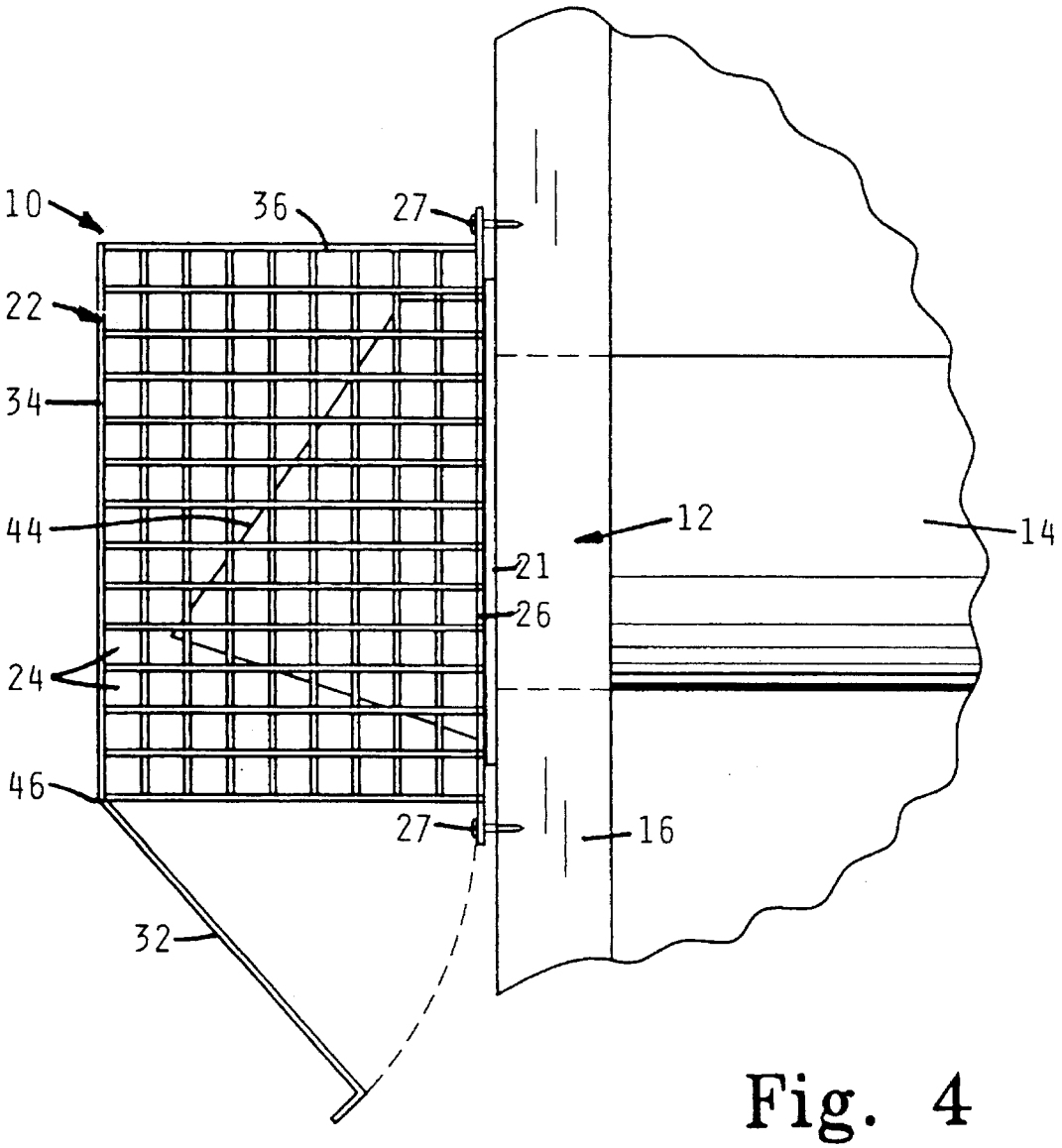
FIG. 4 is a pictorial fragmental view as shown in FIG. 3, except that the auxiliary device's bottom panel is shown swung to an open position as in FIG. 1.
Figure 5:
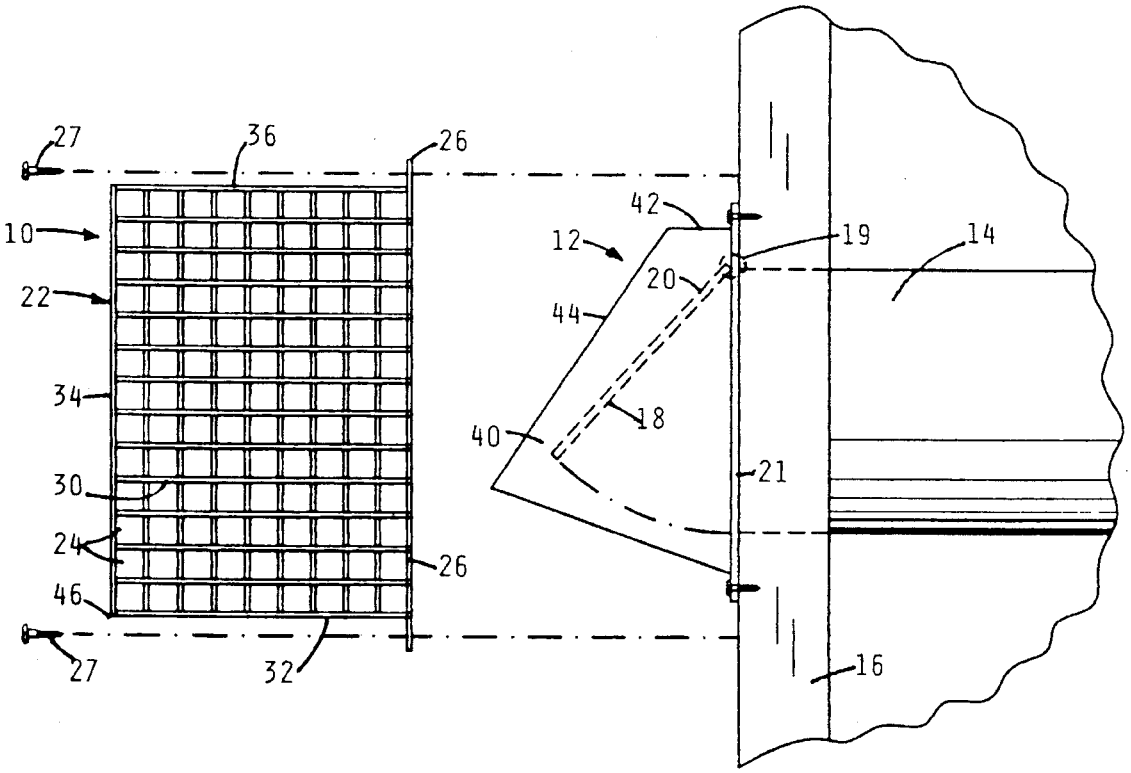
FIG. 5 is a pictorial detail view of the device and associated structure as per FIGS. 3 and 4, except that the auxiliary device is shown in a position ready for installation, in an exploded view showing, and with the associated vent outlet opening being shown as provided with its closure flap.

Conventionally, the vent duct outlet 12 is connected to the wall 16 as shown (FIGS. 1 and 3–5) extends outwardly of the wall 16, and the outlet 12 has a movable closure flap means 18 (FIG. 5), the flap 18 being movably supported (hinge 19) between a substance-discharge position 20, which permits the exhaust substance to be discharged through the vent duct outlet 12, and a closed (vertical) position hidden in FIGS. 4 and 5 against the outlet 12's mounting panel 21, providing a loosely held closure of the vent duct outlet 12.

The protector auxiliary 10 is shown as comprising a cage-like body member 22, comprising an enclosure formed by panel means having a multiplicity of opening means 24 sized to block entry from the wall 16's exterior, inwardly toward the associated clothes dryer equipment, of matter of any size significantly larger than the particles of exhaust substance (typically small lint fragments and moisture condensate) for which the auxiliary 10 is provided.

The cage-like body member 22 is shown as having a peripheral flange means 26 by which the cage-like body member 22 is connected to the wall 16, as by screws 27; and, as an enclosure, the body member 22 is formed of two side panels 30, a bottom panel 32, and outer panel 34, and a top panel 36, all conveniently of a generally retangular form.

The size and spacing of the panels 30/32/34/36 is such that they loosely overlie the exterior portions of the associated equipment's outlet 12, i.e., its side panels 40, top panel 42, and its exterior-facing slanted panel 44, that panel 44 of a conventional prior art outlet 12 being slanted so as to baffle or direct the lint particles downwardly rather than objectionably more visibly out into the residence's yard.

As shown, providing for the removal of sediment or the like which after a time may have collected in the cage-like body member 22, the cage-like body member 22 is shown provided with hinge means 46 for a portion of the panel means 30/32 (here 32) which permits the panel means portion 32 to be movable to an open condition (FIGS. 1 and 4) such that a user may reach into a cage-like body member 22 to remove such sediment.

Figure 2:
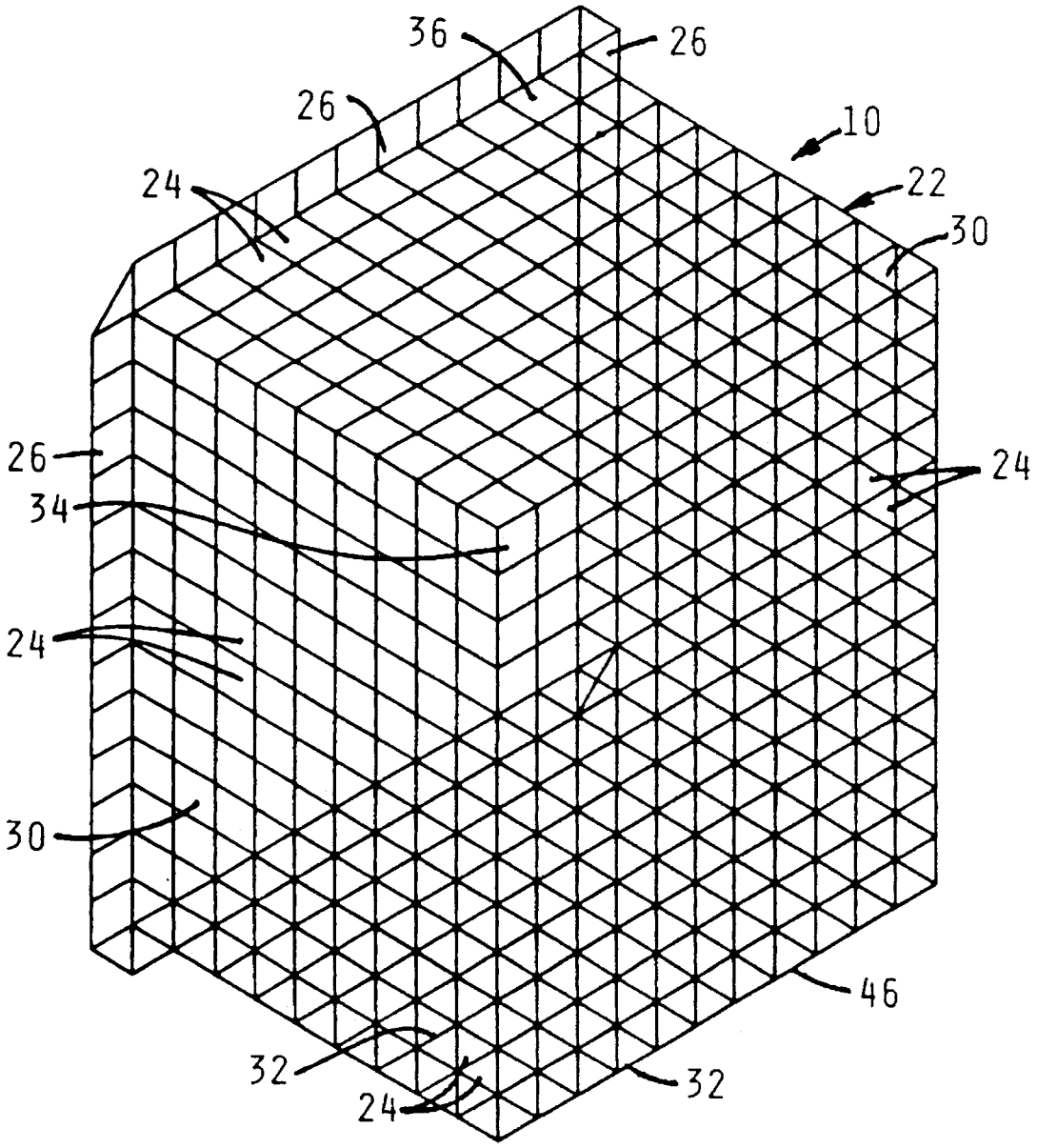
FIG. 2 is a somewhat enlarged view, also in isometric pictorial form, of the protector auxiliary device shown in FIG. 1.
Figure 3:
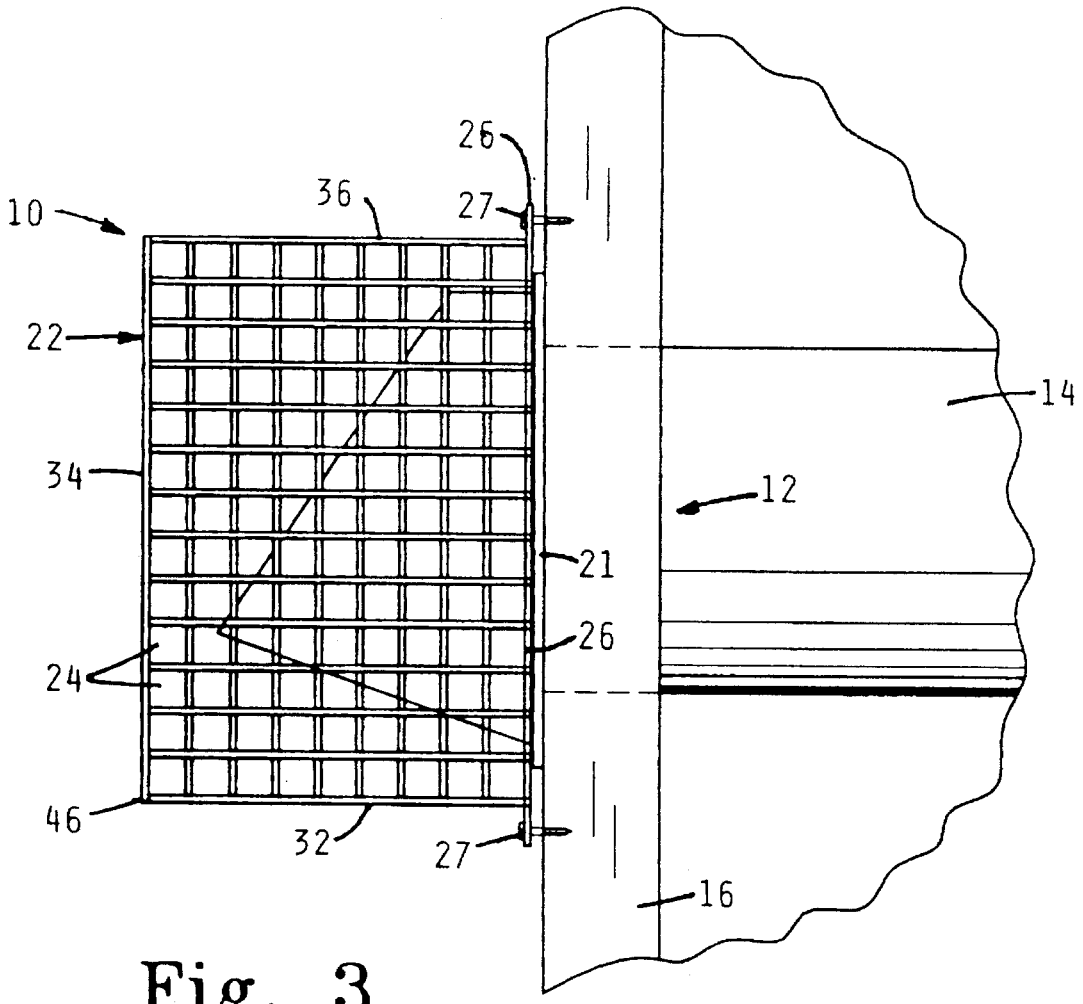
FIG. 3 is a fragmental detail view of an associated building structure for which the associated vent duct outlet has been installed, and with the outlet protector auxiliary of FIGS. 1 and 2 shown attached to the building wall, the showing being a side-elevation view of the auxiliary device with its bottom panel closed as in FIG. 2.

In a desired form, the protector auxiliary 10 is formed of stiff metal cloth having an open-mesh nature of about one half inch size. Such metal cloth is stiff enough, yet bendable, such that the inventor has found that no hinge pin or latching feature need be provided to enable the panel 32 being easily and repeatedly able to be pushed into either its enclosure position (FIGS. 2,3, and 5) or its clean-out position (FIGS. 1 and 4).

Accordingly, the barrier, provided by the panelling 30/30/32/34/36 blocks the entry of birds or other animal life from entering the duct 14 in a typical accessory duct 12/14 installation, in which the position of the closure flap means 18 in substance-discharge position, and any partially or fully open position thereof and/or loss of any portion thereof, would permit the disadvantages of animal life entering into the vent duct 14, and/or cold air to enter into the vent duct 14.

SUMMARY OF OPERATIONAL DETAILS, AND THEIR ADVANTAGES

The present invention as detailed herein has advantages in both concept and in component parts and features; for in contrast to other articles known to the inventor as to the prior art mentioned, the invention provides advantageous features which should be considered, both as to their individual benefit, and to whatever may be considered to be also their synergistic benefit toward the invention as a whole. Such features include:

(a) Easy to use and to install;

(b) Certain as to protective effects;

(c) Economical of formation and of installation task;

(d) No adverse effect on exhaust duct or flap-closure operativity;

(e) Not unattractive;

(f) Standardized size fits most installations;

(f) Virtually eliminates bother once installed; and (h) Long lasting, with minimal or no maintenance.

CONCLUSION AS TO INVENTION COMBINATION

It is thus seen that a ductwork outlet protector auxiliary assembly constructed and used according to the combination of inventive concepts and details herein set forth, provides novel concepts of a desirable and usefully advantageous article and procedure, yielding advantages which are and provide special and particular advantages when used as herein set forth.

In summary as to the nature of the overall assembly's advantageous concepts, their novelty and inventive nature is shown by novel features of concept and construction shown here in advantageous combination and by the novel concepts hereof not only being different from all the prior art known, even though other duct protectors have been known and used for scores of years, but because the achievement is not what is or has been suggested to those of ordinary skill in the art, especially realistically considering this as a novel combination comprising components which Individually are similar in nature to what is well known to most all persons, surely including most of the many makers and users of ductwork and related hardware for a number of years, throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long worldwide use of various types of ductwork and related hardware.

The differences of concept and construction as specified herein yield advantages over the prior art; and the lack of this invention by the prior art, as a prior art combination, has been in spite of this invention's apparent simplicity of the construction once the concepts have been conceived, in spite of the advantages it would have given, and in spite of the availability of all the materials, to all persons of the entire world, and the invention's non-technical and openly-visible nature.

Quite certainly this particular combination of prior art details as here presented in this overall combination has not been suggested by the prior art, this achievement in its particular details and utility being a substantial and advantageous departure from prior art, even though the prior art has had similar components for numbers of years. And particularly is the overall difference from the prior art significant when the non-obviousness is viewed by a consideration of the subject matter of this overall device as a whole, as a combination integrally incorporating features different in their combination from the prior art, in contrast to merely separate details themselves, and further in view of the prior art not achieving particular advantages here achieved by this combination.

Accordingly, it will thus be seen from the foregoing description of the invention according to this illustrative embodiment, considered with the accompanying drawings, that the present invention provides new and useful concepts of a novel and advantageous article and procedure, possessing and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

The Invention claim is:

1. An accessory vent duct outlet protector auxiliary, provided as an additive attachment for an associated accessory vent duct outlet which leads exhaust substance from associated equipment interiorly of a wall to venting discharge exteriorly of the wall, the associated vent duct outlet being connected to the wall, and extending outwardly of the wall, and having a movable closure flap means which is movably supported in and between a substance-discharge position which permits the exhaust substance to be discharged through the vent duct outlet and a closed position providing a loosely held barrier of said vent duct outlet, the auxiliary attachment comprising a framework providing a cage-like body member, the cage-like body member comprising panel means having opening means therein of restricted size such as to permit discharge of exhaust substance through the opening means but to block entry from the wall's exterior, inwardly toward the associated equipment, of matter of any size significantly larger than the particles of exhaust substance for which the auxiliary attachment is provided, the cage-like body member having a peripheral flange means by which the cage-like body member may be operatively connected to the assembly of vent duct outlet and wall;

and the flange means is so located with respect to the panel means, and the panel means has a shape, form, and size, such that the flange means is operatively connectable to the wall with the panel means providing an additive enclosure attachment fitting over and enclosing the vent duct outlet.

2. An accessory vent duct outlet protector auxiliary as set forth in claim 1, in a combination in which the cage-like body member has a bottom panel means and a vertical panel means, there being opening means in both panel means.

3. An accessory vent duct outlet protector auxiliary as set forth in claim 1, in a combination in which a portion of the cage-like body member is provided with hinge means for a portion of the panel means which permits said panel means portion to be movable to an open condition such that a user may reach into the cage-like body member to remove sediment or the like which has collected in the cage-like body member.

4. An accessory vent duct outlet protector auxiliary as set forth in claim 2, in a combination in which the opening means are provided by providing the cage-like body member to be formed of stiff metal cloth having an open-mesh nature of about one half inch size.

5. An accessory vent duct outlet protector auxiliary, as set forth in claim 1, in a combination in in which the vent duct outlet is provided for associated equipment which is a clothes dryer, and the associated substance of discharge is a mixture of air, clothing lint, and moisture, the moisture being in the form of gas or condensate depending upon the nature of the system; and the position of the closure flap means in substance-discharge position, and any partially or fully open position thereof and/or loss of any portion thereof, permits the disadvantages of animal life to enter into the vent duct and/or cold air to enter into the vent duct.

6. An accessory vent duct outlet protector auxiliary as set forth in claim 1, in a combination in which the accessory vent duct outlet has its movable closure flap means also outwardly of the wall, and the cage-like body member encloses the movable closure flap means outwardly of the wall.

7. An accessory vent duct outlet protector auxiliary as set forth in claim 2, in a combination in which the accessory vent duct outlet has its movable closure flap means also outwardly of the wall, and the cage-like body member encloses the movable closure flap means outwardly of the wall.

8. An accessory vent duct outlet protector auxiliary as set forth in claim 3, in a combination in which the accessory vent duct outlet has its movable closure flap means also outwardly of the wall, and the cage-like body member encloses the movable closure flap means outwardly of the wall.

9. An accessory vent duct outlet protector auxiliary as set forth in claim 4, in a combination in which the accessory vent duct outlet has its movable closure flap means also outwardly of the wall, and the cage-like body member encloses the movable closure flap means outwardly of the wall.

10. An accessory vent duct outlet protector auxiliary as set forth in claim 5, in a combination in which the accessory vent duct outlet has its movable closure flap means also outwardly of the wall, and the cage-like body member encloses the movable closure flap means outwardly of the wall.

11. An accessory vent duct outlet protector auxiliary as set forth in claim 3, in a combination in which one of the panel means is a bottom panel means; and it is the bottom panel means which is provided with the hinge means.

12. An accessory vent duct outlet protector auxiliary as set forth in claim 1, in a combination in which one of the panel means is a bottom panel means; and it is spaced below the elevation of the associated vent duct outlet.

13. An accessory vent duct outlet protector auxiliary as set forth in claim 1, in a combination in which one of the panel means is an outer panel means, and it is located so as to be spaced outwardly of the vent duct outlet.

14. An accessory vent duct outlet protector auxiliary as set forth in claim 12, in a combination in which one of the panel means is an outer panel means, and it is located so as to be spaced outwardly of the vent duct outlet.

* * * * *

UNITED STATES PATENT AND TRADEMARK OFFICE

CERTIFICATE OF CORRECTION

PATENT NO. : 5,547,422
DATED : August 20, 1996
INVENTOR(S) : David A. Seboldt

It is certified that error appears in the above-identified patent and that said Letters Patent is hereby corrected as shown below:

In the Abstract, 3rd line from the bottom; change "panel" to: -- panels --.

Col. 5, line 12; before "as" insert: -- details --.

Col. 5, line 16; change "required" to: -- requires --.

Col. 5, line 20; after "ordinary" insert: -- skill --.

Col. 7, line 19; change "Invention" to: -- INVENTIVE --.

Col. 8, line 20; change "claim" to: -- claimed --.

Col. 8, line 46; delete "assembly of".

Signed and Sealed this

Twelfth Day of November, 1996

Bruce Lehman

*Attest:*

BRUCE LEHMAN

*Attesting Officer*

*Commissioner of Patents and Trademarks*